US010810979B2

(12) United States Patent
Yan et al.

(10) Patent No.: US 10,810,979 B2
(45) Date of Patent: Oct. 20, 2020

(54) KEY ASSISTED USER INPUT SYSTEM AND METHOD FOR A PIANO SYSTEM

(71) Applicant: SUNLAND INFORMATION TECHNOLOGY CO., LTD., Shanghai (CN)

(72) Inventors: Bin Yan, Shanghai (CN); Zhengjun Yan, Shanghai (CN)

(73) Assignee: SUNLAND INFORMATION TECHNOLOGY CO., LTD., Shanghai (CN)

( * ) Notice: Subject to any disclaimer, the term of this patent is extended or adjusted under 35 U.S.C. 154(b) by 0 days.

(21) Appl. No.: 16/512,788

(22) Filed: Jul. 16, 2019

(65) Prior Publication Data

US 2019/0341009 A1 Nov. 7, 2019

Related U.S. Application Data

(63) Continuation of application No. PCT/CN2017/071848, filed on Jan. 20, 2017.

(51) Int. Cl.
*G10H 1/00* (2006.01)
*G10G 3/04* (2006.01)
(Continued)

(52) U.S. Cl.
CPC ..... *G10G 3/04* (2013.01); *G10G 1/02* (2013.01); *G10G 7/00* (2013.01); *G10H 1/0066* (2013.01);
(Continued)

(58) Field of Classification Search
CPC ..... G10H 1/0008; G10H 1/368; G10H 2220/101; G10H 1/34; G10H 2220/106;
(Continued)

(56) References Cited

U.S. PATENT DOCUMENTS 3,837,256 A * 9/1974 Gullickson ..... G09B 15/08 84/478
5,907,115 A * 5/1999 Matsunaga ..... G09B 15/003 84/477 R
(Continued)

FOREIGN PATENT DOCUMENTS

CN 102478959 A 5/2012
CN 202331880 U 7/2012
(Continued)

OTHER PUBLICATIONS

Written Opinion in PCT/CN2017/071848 dated Oct. 23, 2017, 4 pages.
(Continued)

*Primary Examiner* — Marlon T Fletcher
(74) *Attorney, Agent, or Firm* — Metis IP LLC

(57) ABSTRACT

A piano system with key assisted user input may include one or more execution devices, one or more sensors, at least one signal processing circuit, a processor and a display. The one or more sensors may be configured to detect a signal indicating a status change of at least one of the one or more execution devices. The at least one signal processing circuit may be configured to generate a control signal for controlling an input of a computer device in response to the signal detected by the one or more sensors. The processor may be configured to process the control signal to determine content to be displayed on a user interface. The display may be configured to display the determined content on the user interface.

18 Claims, 11 Drawing Sheets

(51) Int. Cl.
*G10G 1/02* (2006.01)
*G10G 7/00* (2006.01)

(52) U.S. Cl.
CPC . *G10H 2220/005* (2013.01); *G10H 2220/305* (2013.01)

(58) Field of Classification Search
CPC ..... G10H 2220/096; G10H 1/0016; G10H 1/344; G10H 2220/241; G10H 2220/221; G10H 2220/111; G10H 2220/126; G10H 2220/061; G10H 2220/091; G10H 2220/121; G10H 2220/231; G10H 2220/066; G10H 2220/116; G09B 15/08; G10G 1/04; G10C 3/00; G10C 3/12; B25J 9/163
See application file for complete search history.

(56) References Cited

U.S. PATENT DOCUMENTS 8,008,563 B1 8/2011 Hastings
8,212,819 B2 7/2012 Yanagawa
8,664,497 B2 3/2014 Taylor
8,901,405 B1 * 12/2014 McCarthy ..... G09B 15/023 84/478
2005/0204908 A1 * 9/2005 Uehara ..... G10G 1/02 84/746
2010/0257993 A1 * 10/2010 Brow ..... A63F 13/814 84/478
2011/0247479 A1 * 10/2011 Helms ..... G10H 1/0016 84/613
2012/0255425 A1 * 10/2012 Oba ..... G10H 1/348 84/746
2013/0061733 A1 * 3/2013 Ohnishi ..... G10C 3/06 84/174
2013/0180377 A1 * 7/2013 Oba ..... G10C 3/26 84/229
2014/0150623 A1 * 6/2014 Fujiwara ..... G10C 3/06 84/192
2014/0202318 A1 * 7/2014 Ohnishi ..... G10H 1/32 84/723
2014/0202321 A1 * 7/2014 Ohnishi ..... G10C 3/06 84/744
2014/0260908 A1 * 9/2014 Yoshikawa ..... G10H 1/00 84/609
2016/0125862 A1 * 5/2016 Takahashi ..... G10H 1/0008 84/602
2018/0322856 A1 * 11/2018 Liu ..... G10H 1/0008
2019/0341009 A1 * 11/2019 Yan ..... G10G 1/02

FOREIGN PATENT DOCUMENTS

CN 102693715 A 9/2012
CN 104505057 A 4/2015
CN 205680413 U 11/2016

OTHER PUBLICATIONS

International Search Report in PCT/CN2017/071848 dated Oct. 23, 2017, 4 pages.

* cited by examiner

KEY ASSISTED USER INPUT SYSTEM AND METHOD FOR A PIANO SYSTEM

CROSS-REFERENCE TO RELATED APPLICATIONS

This application is a continuation of International Application No. PCT/CN2017/071848 filed on Jan. 20, 2017, the entire contents of which are hereby incorporated by reference.

TECHNICAL FIELD

This application relates to a piano system and, more particularly, relate to a piano system equipped with an information input system.

BACKGROUND

A piano (e.g., an acoustic piano) is a musical instrument played using a keyboard. As one of the world's most popular musical instruments, the piano is widely played today. A piano student may find it difficult to learn fingering and hand positions, fingering sequences, pedaling techniques, and other piano techniques. Smart piano, a visualized and personalized teaching system, has been created to assist student in learning piano. It is desirable necessary to provide a user with a user interface utilizing the keys or the pedals of the piano.

SUMMARY

According to an aspect of the present disclosure, a piano system with key assisted user input may include one or more execution devices, one or more sensors, at least one signal processing circuit, a processor and a display. The one or more sensors may be configured to detect a signal indicating a status change of at least one of the one or more execution devices. The at least one signal processing circuit may be configured to generate a control signal for controlling an input of a computer device in response to the signal detected by the one or more sensors. The processor may be configured to process the control signal to determine content to be displayed on a user interface. The display may be configured to display the determined content on the user interface.

In some embodiments, the piano system may further include one or more storage media. The one or more storage media may include a set of instructions for processing the control signal to determine information to be displayed on the user interface.

In some embodiments, the control signal may include an auto-play control signal. The piano system may further include an auto-play actuator. The auto-play actuator may be configured to execute an auto-play operation of the piano in response to the auto-play control signal.

In some embodiments, the one or more execution devices may include one or more keys, one or more pedals, one or more hammers, and one or more strings.

In some embodiments, the status change of at least one of the one or more execution devices may include at least one of: a position change of at least one of the one or more keys, a position change of at least one of the one or more hammers, a position change of at least one of the one or more pedals, a vibration status change of at least one of the one or more strings and a sound frequency change of the piano.

In some embodiments, the status change of at least one of the one or more execution devices may be caused by a user operation on the piano.

In some embodiments, the control signal may include a Human Interface Device (HID) signal.

In some embodiments, the computer device may be removable from the piano system, and the control signal may be transmitted from the piano system wirelessly to the computer device.

In some embodiments, the content of the user interface may include a plurality of buttons, each of which is clickable in response to at least a key pressing of the piano system and an area for displaying one or more inputs in response to one or more key pressings of the piano system, respectively.

In some embodiments, the content of the user interface may further include an indicator area. The indicator area may include a plurality of characters and one or more symbols, each of which indicating a correspondence between one of the one or more keys of the piano system and one of the plurality of characters and the one or more symbols.

According to another aspect of the present disclosure, a method implemented on a computer device having at least one processor, a storage medium, and a communication platform connected to a network for key assisted user input in a piano system may include: detecting, by one or more sensors, a signal indicating a status change of at least one of one or more execution devices of the piano system, generating, by at least one signal processing circuit, a control signal for controlling an input of a computer device in response to the signal detected by the one or more sensors, determining, by the at least one processor, content to be displayed on a user interface by processing the control signal and displaying the determined content on the user interface.

Additional features will be set forth in part in the description which follows, and in part will become apparent to those skilled in the art upon examination of the following and the accompanying drawings or may be learned by production or operation of the examples. The features of the present disclosure may be realized and attained by practice or use of various aspects of the methodologies, instrumentalities and combinations set forth in the detailed examples discussed below.

BRIEF DESCRIPTION OF THE DRAWINGS

The present disclosure is further described in terms of exemplary embodiments. These exemplary embodiments are described in detail with reference to the drawings. These embodiments are non-limiting exemplary embodiments, in which like reference numerals represent similar structures throughout the several views of the drawings, and wherein.

DETAILED DESCRIPTION

In the following detailed description, numerous specific details are set forth by way of examples in order to provide a thorough understanding of the relevant disclosure. However, it should be apparent to those skilled in the art that the present disclosure may be practiced without such details. In other instances, well known methods, procedures, systems, components, and/or circuitry have been described at a relatively high-level, without detail, in order to avoid unnecessarily obscuring aspects of the present disclosure. Various modifications to the disclosed embodiments will be readily apparent to those skilled in the art, and the general principles defined herein may be applied to other embodiments and applications without departing from the spirit and scope of the present disclosure. Thus, the present disclosure is not limited to the embodiments shown, but to be accorded the widest scope consistent with the claims.

It will be understood that the term "system," "unit," "module," and/or "engine" used herein are one method to distinguish different components, elements, parts, section or assembly of different level in ascending order. However, the terms may be displaced by other expression if they may achieve the same purpose.

It will be understood that when a unit, module or engine is referred to as being "on," "connected to" or "coupled to" another unit, module, or engine, it may be directly on, connected or coupled to, or communicate with the other unit, module, or engine, or an intervening unit, module, or engine may be present, unless the context clearly indicates otherwise. As used herein, the term "and/or" includes any and all combinations of one or more of the associated listed items.

The terminology used herein is for the purposes of describing particular examples and embodiments only, and is not intended to be limiting. As used herein, the singular forms "a," "an," and "the" may be intended to include the plural forms as well, unless the context clearly indicates otherwise. It will be further understood that the terms "include," and/or "comprise," when used in this disclosure, specify the presence of integers, devices, behaviors, stated features, steps, elements, operations, and/or components, but do not exclude the presence or addition of one or more other integers, devices, behaviors, features, steps, elements, operations, components, and/or groups thereof.

Figure 1:
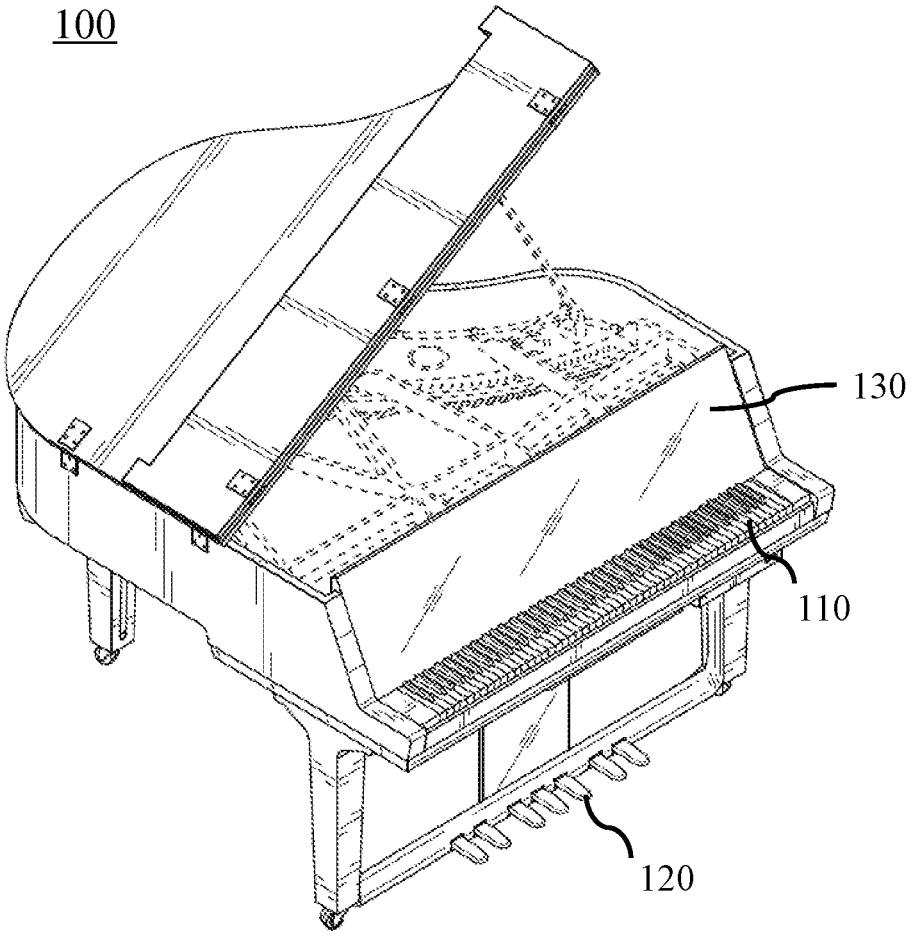
FIG. 1 is a schematic diagram illustrating an exemplary piano system according to some embodiments of the present disclosure.

FIG. 1 is a schematic diagram illustrating an exemplary piano system according to some embodiments of the present disclosure. Piano system 100 may include, among others, a keyboard 110 with a plurality of keys, one or more pedals 120, and a display 130. In some embodiments, display 130 may be configured with piano system 100 and disposed above keyboard 110 (as shown in FIG. 1). The length of display 130 disposed above keyboard 110 may be the same as or less than the length of keyboard 110. In some embodiments, if the length of display 130 is the same as keyboard 110, the length of a simulated keyboard displayed on display 130 may be the same as keyboard 110. Display 130 may be mounted to piano system 100 via a holder (not shown in the figure). In some embodiments, display 130 may be connected to one or more components of piano system 100 wirelessly. In some embodiments, a user interface may be displayed on display 130 for the user to interact with piano system 100. The user may use one or more keys of keyboard 110 and/or one or more pedals 120 to control piano system 100. In some embodiments, the controlling may be executed according to an instruction or an operation suggestion displayed on the user interface. In some embodiments, the user may execute the controlling without an operation suggestion shown on the user interface. For example, a pressing of one or more fixed keys or pedals may represent a fixed operation instruction preset by piano system 100. The fixed operation instruction may be recorded in the user manual of piano system 100. User may operate by looking up the user manual instead of following an operation suggestion shown on the user interface. The operations performed by the user on the user interface may include typing in characters, selecting a song, moving a cursor, clicking buttons, or the like, or a combination thereof. The other components included in piano system 100 may include but not limited to a tone generator, a piano wire, a damper, a soundboard, a hammer, or the like, or a combination thereof.

Figure 2:
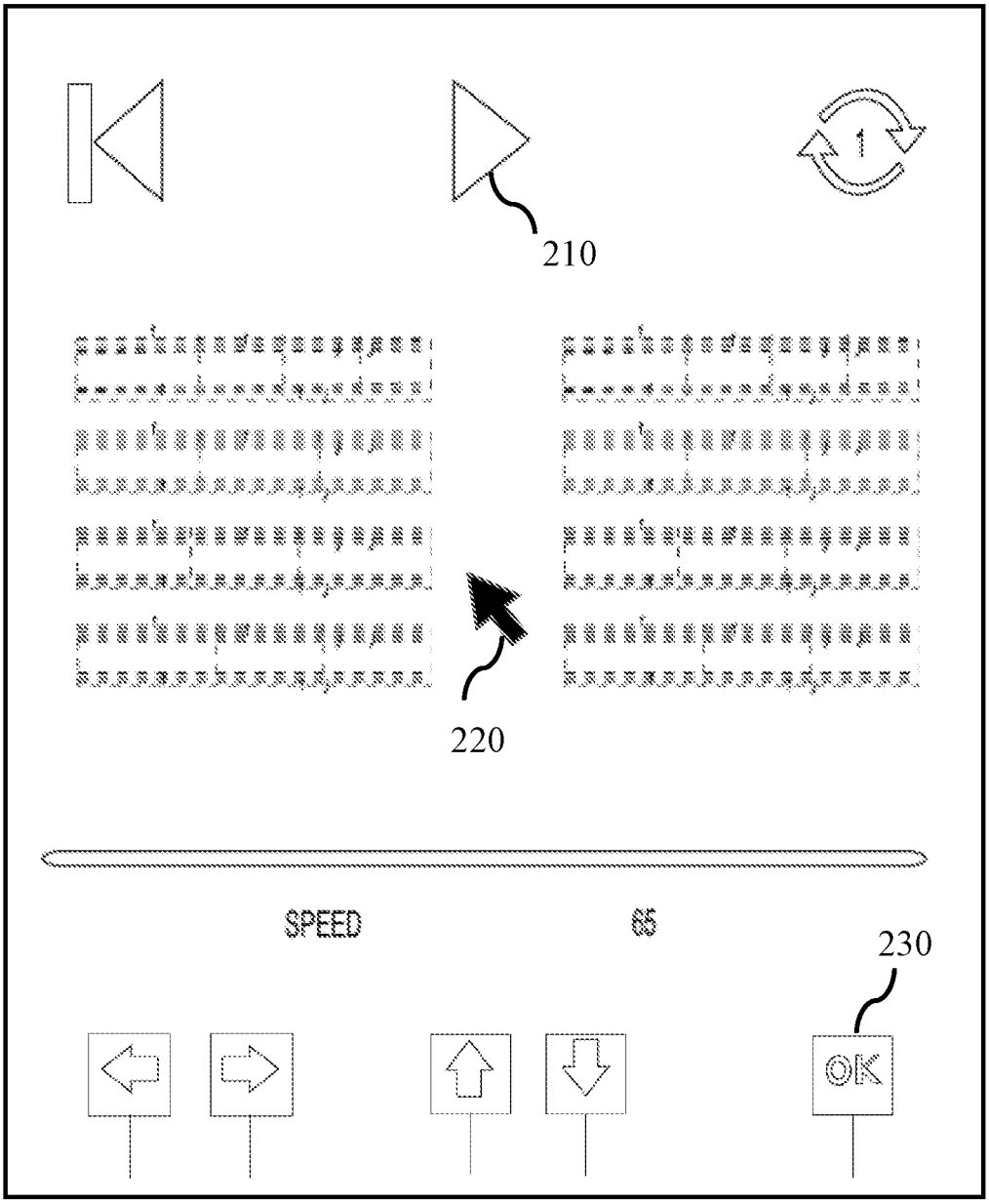
FIG. 2 is a schematic diagram illustrating an example user interface on a display of a piano system according to some embodiments of the present disclosure.

FIG. 2 is a schematic diagram illustrating an example user interface on a display of a piano system according to some embodiments of the present disclosure. In some embodiments, one or more buttons 210 and a cursor 220 may be displayed on user interface 200. User interface 200 may display one or more real-time performance scores during an operation of piano system 100 when operating an application software of which. On user interface 200, a music score may be displayed in the main area of display 130. One or more buttons 210 may be displayed around the music sore. One of one or more buttons 210 may represent one type of operation to piano system 100. For example, when the piano system is configured to play a song automatically, one of one or more buttons 210 may represent starting the playing. In some other embodiments, one or more buttons may represent a plurality of functions. Exemplary functions may include stopping playing, repeating, speeding up, confirming an operation, or the like, or a combination thereof. In some embodiments, user interface 200 may display one or more buttons 230 controlled by the plurality of keys of keyboard 110 for convenient on the bottom. A solid line may be provide beneath each of one or more buttons 230 and aligned to a key of keyboard 110. The alignment may indicate that each of the one or more buttons 230 may be pressed by pressing the corresponding key of keyboard 110. Therefore, the key pressing method according to the present disclosure facilitates a user to press the buttons displayed on the bottom of the user interface. In some embodiments, one of one or more buttons 210 displayed on the top of the user interface may be trigged by cursor 220. In some other embodiments, cursor 220 may be controlled to move to a button by a plurality of pressing operations on keyboard 110. And like a mouse click, a key pressing may simulate the click operation to click the button where the cursor stops at.

Figure 3:
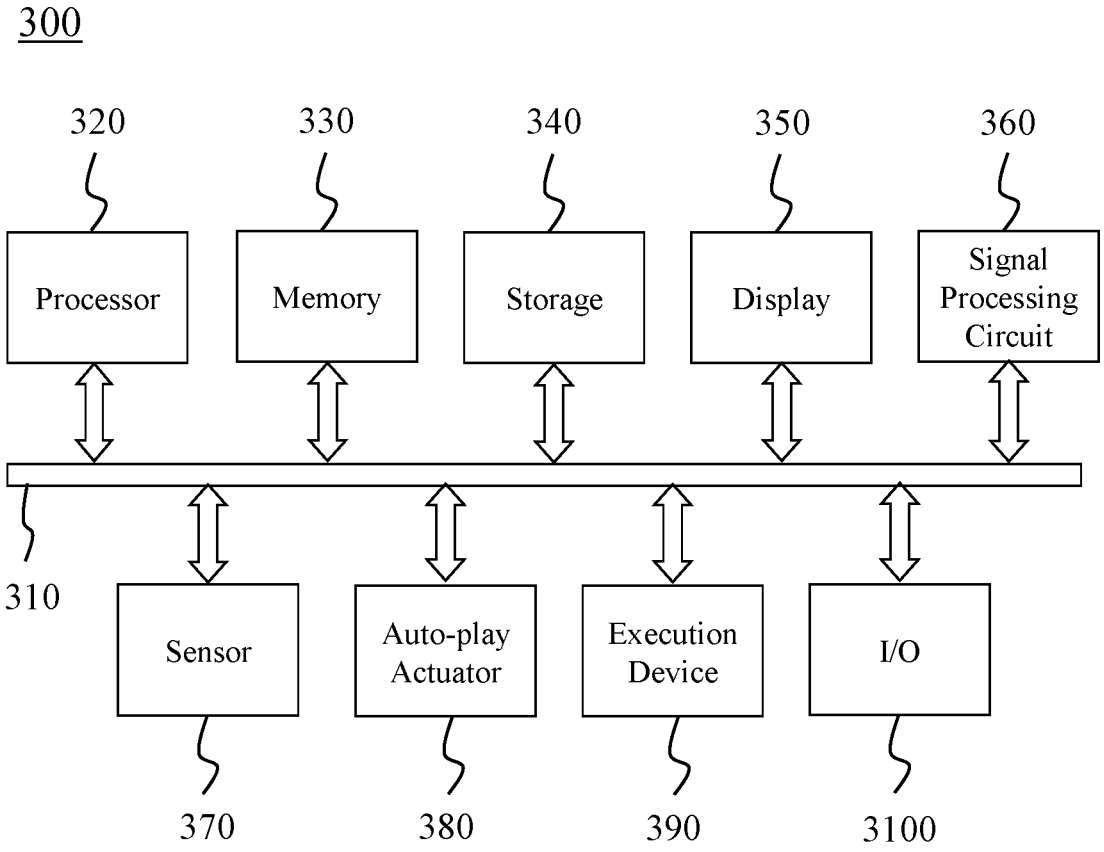
FIG. 3 is a device diagram illustrating an exemplary piano system according to some embodiments of the present disclosure.

FIG. 3 is a device diagram illustrating an exemplary piano system according to some embodiments of the present disclosure. As shown in FIG. 3, piano system 100 may include a data bus 310, a processor 320, a memory 330, a storage 340, a display 350, a signal processing circuit 360, one or more sensors 370, an auto-play actuator 380, an execution device 390, I/O devices 3100, and/or any other components for providing piano system 100. More or less components may be included in piano system 100 without loss of generality and its functionality. For example, two of the components of piano system 100 may be integrated into a single component. In the alternative, one of the components of piano system 100 may include two or more other components. The components may be integrated via data bus 310 respectively. Data bus 310 may be used to transmit data among the components disclosed above.

In some embodiments, processor 320 may be configured to process a control signal generated by pressing the key or the pedal. Merely by way of example, processor 320 may include a microcontroller, a reduced instruction set computer (RISC), an application specific integrated circuits (ASICs), an application-specific instruction-set processor (ASIP), a central processing unit (CPU), a graphics processing unit (GPU), a physics processing unit (PPU), a microcontroller unit, a digital signal processor (DSP), a field programmable gate array (FPGA), an acorn reduced instruction set computing (RISC) machine (ARM), and any other circuit and/or processor capable of executing the functions described herein, or the like, or any combination thereof. Memory 330 may be configured to store data during the operation of piano system 100. Memory 330 may include a random-access memory (RAM), a dynamic random-access memory (DRAM), a static random-access memory (SRAM), a thyristor random-access memory (T-RAM), a zero-capacitor random-access memory (Z-RAM), a read-only memory (ROM), a mask read-only memory (MROM), a programmable read-only memory (PROM), a field programmable read-only memory (FPROM), one-time programmable non-volatile memory (OTP NVM), and any other circuit and/or memory capable of executing the functions described herein, or the like, or any combination thereof. Storage 340 may be configured to store some songs or user information. The storage 340 may include a direct attach storage (DAS), a fabric-attached storage (FAS), a storage area network (SAN), a network attached storage (NAS), any other circuit and/or storage capable of executing the functions described herein, or the like, or any combination thereof. Display 350 may be configured to display a user interface. Display 350 may include a electroluminescent display (ELD), a light emitting diode display (LED), a cathode ray tube (CRT), a liquid-crystal display (LCD), a plasma display panel (PDP), an organic light-emitting diode (OLED), an organic light-emitting transistor (OLET), a surface-conduction electron-emitter display (SED), a field omission display (FED), a quantum dot display (QD-LED), a ferroelectric liquid crystal display (FLCD), a telescopic pixel display (TPO), a laser-powered phosphor display (LPD), any other circuit and/or display capable of executing the functions described herein, or the like, or any combination thereof. Generally, processor 320, memory 330, storage 340, display 350 and some other components may be integrated into one device, e.g., desktop, laptop, mobile phone, tablet computer, wearable computing device, or the like, or a combination thereof.

Signal processing circuit 360 may be configured to process signals detected by sensor 370 or received from any other components for providing to piano system 100. Exemplary signal processing circuit 360 may include a signal amplification circuit, a signal conversion circuit, a signal filtering circuit, any other circuit capable of executing the functions described herein, or the like, or any combination thereof. Sensor 370 may be configured to monitor any operations performed by a player on the piano and generate musical data accordingly. Sensor 370 may include a current sensor, a voltage detector, a position sensor, a pressure sensor, any other circuit and/or sensor capable of executing the functions described herein, the like, or any combination thereof.

Auto-play actuator 380 may be configured to receive the musical data generated by sensor 370 and generate an auto-play command by cooperating with other components of piano system 100. Exemplary musical data may include keys that are pressed or released, times when one or more pedals are operated, pressure levels received on the pedals, one or more musical notes to be produced, etc. Auto-play actuator 380 may generate sounds and/or images based on the musical data. Auto-play actuator 380 may include any circuit and/or device capable of executing the functions described herein.

Execution device 390 may be configured to execute the auto-play command generated by auto-play actuator 380. Execution device 390 may be a component of piano system 100 that executes mechanical motion, such as solenoid actuator, key actuator, pedal actuator, motor, etc.

I/O device 3100 may be configured to allow a player to interact with piano system 100. I/O device 3100 may include one or more common input and output devices in addition to the display, e.g., keyboard, mouse, audio, printer, etc. In some embodiments, I/O device 3100 may be configured to allow a player to interact with piano system 100 via a touch screen and/or a touchable surface. In some other embodiments, I/O device 3100 may be configured to allow a player to interact with piano system 100 via voice recognition and/or vision recognition.

Figure 4:
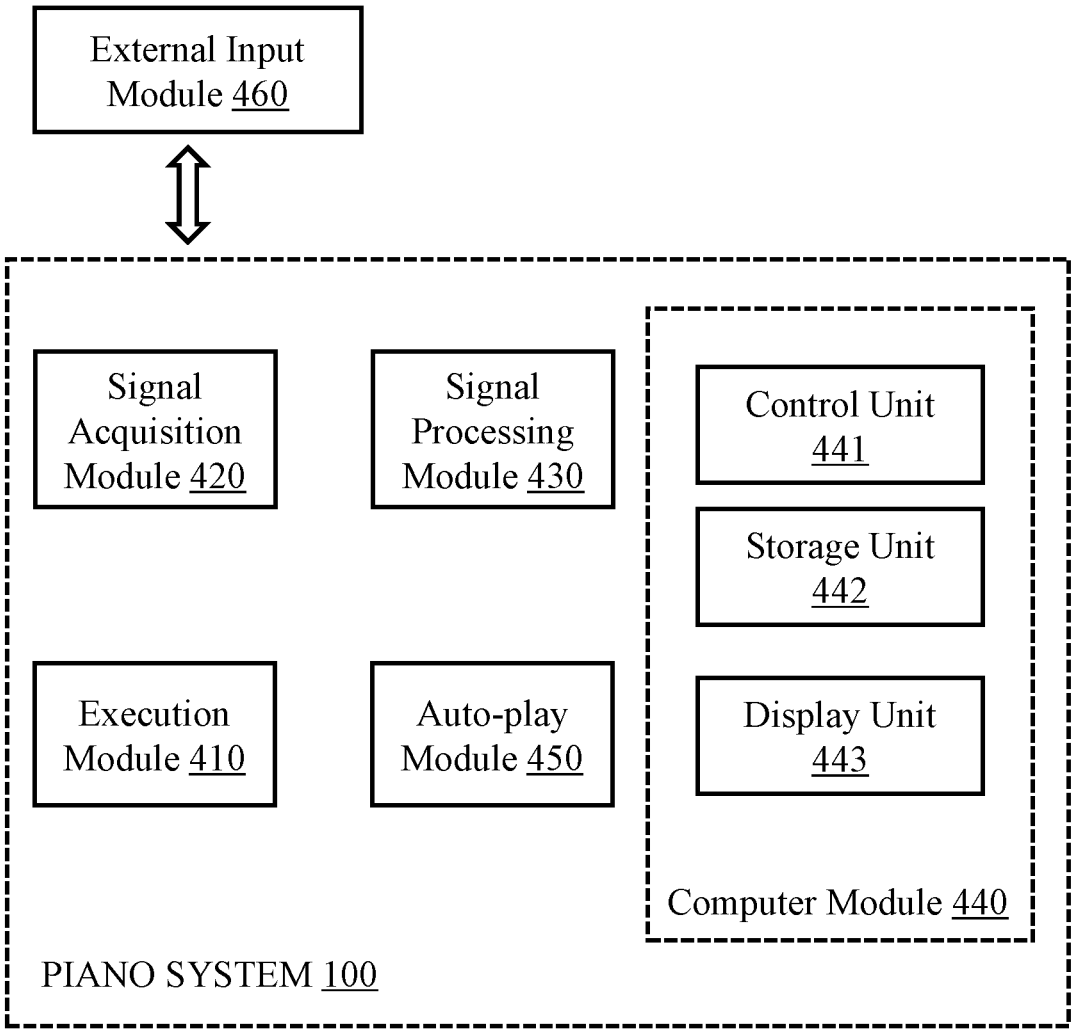
FIG. 4 is a block diagram illustrating an exemplary piano system according to some embodiments of the present disclosure.

FIG. 4 is a block diagram illustrating an exemplary piano system according to some embodiments of the present disclosure. As shown in FIG. 4, piano system 100 may include an execution module 410, a signal acquisition module 420, a signal processing module 430, a computer module 440, and an auto-play module 450. An external input module 460 may be configured to connect to piano system 100. Computer module 440 may further include a control unit 441, a storage unit 442 and a display unit 443.

Execution module 410 may include execution device 390 disclosed in FIG. 3. As used herein, execution device 390 may refer to the plurality keys of keyboard 110, the one or more pedals of the piano system, or any other components of the piano that may be activated during the operation of the piano system. The components of piano system 100 that may be activated include but not limit to, a hammer, a speaker, a piece of string of the piano, or any other mechanical components of the piano, or the like, or a combination thereof. In some embodiments, execution module 410 may generate an event in response to a user performance. The type of the event generated by execution module 410 may include but not limit to motion, sound, vibration, or the like, or a combination there of. The type of the event generated by execution module 410 may depend on execution device 390 included therein. For example, if a user presses a key, a key motion may be defined as an event. In another example, the pedal motion trod by the user may be defined as an event. In general, an event may be defined as a motion of a component of piano system 100 in response to a motion of a key and/or a pedal. For example, a hammer may strike a piece of string of the piano system in response to a key pressing event. The motion of the hammer may be defined as an event and the vibration of the string may be defined as another event. The vibration of the piece of string generates a sound, which may be defined as a different event. In some embodiments, the event may contain control information inputted by the user. The control information may be represented by where the event happens and/or how the event happens. For example, the key pressing event happens in the first key of keyboard 110 may represent different control information from the key pressing event happens in the second of keyboard 110. In another example, the sound generated by pressing a key may be different from the sound generated by pressing another key. In some embodiments, the control information of a pressing event may also include the pressing strength and/or the pressing time duration of a key Signal acquisition module 420 may be configured to detect a plurality of signals. The plurality of signals may include a plurality of events generated by execution module 410 as disclosed above. Signal acquisition module 420 may include sensors 370 disclosed in FIG. 3. As stated above, the control information may include information related to where the event happens and how the event happens. Sensors 370 included in signal acquisition module 420 may be used to determine the characteristics of the plurality of events. The configuration of sensors 370 may be determined according to the type of the event to be detected. In some embodiments, the event to be detected may be a mechanical motion of a component of the piano system. The position of sensors 370 may be determined according to where the event happens. For example, sensors 370 may be configured on or near a piece of string to detect a vibration event of the piece of string. In another example, sensors 370 may be configured on or near the plurality of keys to detect the key motion. The number of sensors 370 may be determined according to the complexity level of the controlling of the piano system. For example, if the controlling of the piano system merely includes flipping music score displayed on the user interface, the complexity level of the controlling is determined as low. As a result, fewer sensors need to be used in the piano system. In some embodiments, one sensor 370 may be used to detect multiple events. For example, sensor 370 may be a camera to monitor the key pressing motion. More than one event may detected by the camera. In some embodiments, more than one sensor 370 may be used to detect one event. For example, if the hammer strikes a piece of string, a vibration event and a corresponding sound event may be detected by a vibration detector configured on or near the piece of string and a sound detector configured in the piano system. Sensors 370 included in signal acquisition module 420 may be configured inside or outside of the piano system, and depend on the event to be detected or the method to detect a certain event. For example, if the event to be detected is a sound, sensor 370 may be an external sound detector to the piano system. If the key pressing event is to be detected by a camera, the camera may also be an external device to piano system. Signal acquisition module 420 may generate a detection signal in response to an event detection. The detection signal may be a voltage signal, a current signal, or the like, or a combination thereof.

Signal processing module 430 may be configured to process the detection signal and further transmit the processed detection signal. Signal processing module 430 may include signal processing circuit 360 disclosed in FIG. 3. In some embodiments, the detection signal generated by signal acquisition module 420 may be unrecognizable or unable to be processed by a processing device to further analyze the control information contained in the detection signal. In this case, the detection signal may need to be processed such that it can be used to further analyze the control information contained therein. For example, the processing device is a computer with a USB port. The detection signal may be processed to be a Human Interface Device (HID) signal to simulate a signal generated by a mouse and/or a keyboard. In some embodiments, the detection signal and the processed detection signal may be transmitted to and from the processing device through a wireless connection. In some embodiments, the control information contained in the detection signal may be analyzed in different ways for different purposes. For example, the piano system may work in a recording mode that a user performance data may be collected to generate a Musical Instrument Digital Interface (MIDI) file. The MIDI file may consist of a plurality of MIDI events. A MIDI event may include information related to when a particular key is pressed and/or a particular pedal is trod. Thus, the detection signal may be processed to represent a MIDI event.

Computer module 440 may be configured to receive the processed detection signal transmitted from signal processing module 430. Computer module 440 may include control unit 441, storage unit 442, and display unit 443. Control unit 441 may include processor 320 disclosed in FIG. 3. Control unit 441 may process the received processed detection signal and determine what to display on display unit 443. Storage unit 442 may include memory 330 and storage 340 disclosed in FIG. 3. Storage unit 442 may store user information, MIDI files, videos, or the like, or a combination thereof that can be displayed on display 443. Display unit 443 may include display 350 disclosed in FIG. 3. Display unit 443 may be used to display a user interface to the user. Computer module 440 may be integrated into the piano system or computer module 440 is external to the piano system. In some embodiments, control unit 441 and storage unit 442 of computer module 440 may be disposed inside the piano system and display unit 443 may be configured above keyboard 110 as shown in FIG. 1. In some embodiments, a traditional piano may be upgraded to be a smart piano by applying piano system 100. Under this circumstance, removable computer module 440 may be used to upgrade the traditional piano. The connection between the upgraded traditional piano and removable computer module 440 may be through wired connection or wireless connection. Computer module 440 may be a general computer device. Exemplary computer device may include PC (personal computer), mobile phone, tablet PC, laptop, or the like, or a combination thereof.

Computer module 440 may be used to operate computer applications. The computer applications may be implemented with user interfaces that can be displayed on display unit 443. Buttons on the user interface may be pressed by pressing a corresponding key of keyboard 110 or clicking by a cursor on the user interface. The cursor may be controlled by pressing some specific keys of keyboard 110. In some embodiments, the controlling of the cursor may be more complicated than pressing a key of keyboard 110. Some of the computer applications may be optimized to decrease cursor control by modifying the corresponding user interface. By contrast, some of the computer applications may not be designed to be implemented on piano system 100 according to the present disclosure, and may not have a user-friendly interface for the piano control. Under such circumstance, the cursor control is more significant than modifying the user interface in the operating of such type of computer applications. Under such circumstance, if the processed detection signal is an HID signal, the controlling of the cursor may be easier, and the compatibility of the computer application may be improved accordingly without optimization. Computer module 440 may also be used to generate an auto-play control signal based on the music score to be played. For example, a note of a music score may indicate a striking of a key. An auto-play control signal of striking the key may be generated during playing the note.

Auto-play module 450 may be configured to execute the auto-play function of the piano system according to the auto-play control signal. Auto-play module 450 may include the auto-play actuators disclosed in FIG. 3. In some embodiments, auto-play module 450 may include one or more key actuators, one or more pedal actuators, or any other component implemented in auto-play module 450. The one or more key actuators may strike one or more keys of the piano, respectively. The one or more pedal actuators may operate one or more pedals of the piano, respectively. The key actuators and/or the pedal actuators may be driven by one or more motors. For example, the key actuators and/or the pedal actuators may include one or more digital solenoids to provide energy for striking one or more keys and/or pedals.

External input module 460 may be configured to control computer module 440. External input module 460 may be implemented by I/O device 3100. In some embodiments, when the controlling of computer module 440 by execution module 410 via a keyboard is malfunctioning or unable to execute the complicated operations, external input module 460 may be used to execute the complicated operations. The controlling by external input module 460 may act as a backup method or a compensatory method. External input module 460 may include a keyboard, a mouse, a touch panel, or the like, or a combination thereof. A holder may be integrated to the piano to place the keyboard, the mouse, or the touch panel.

Figure 5:
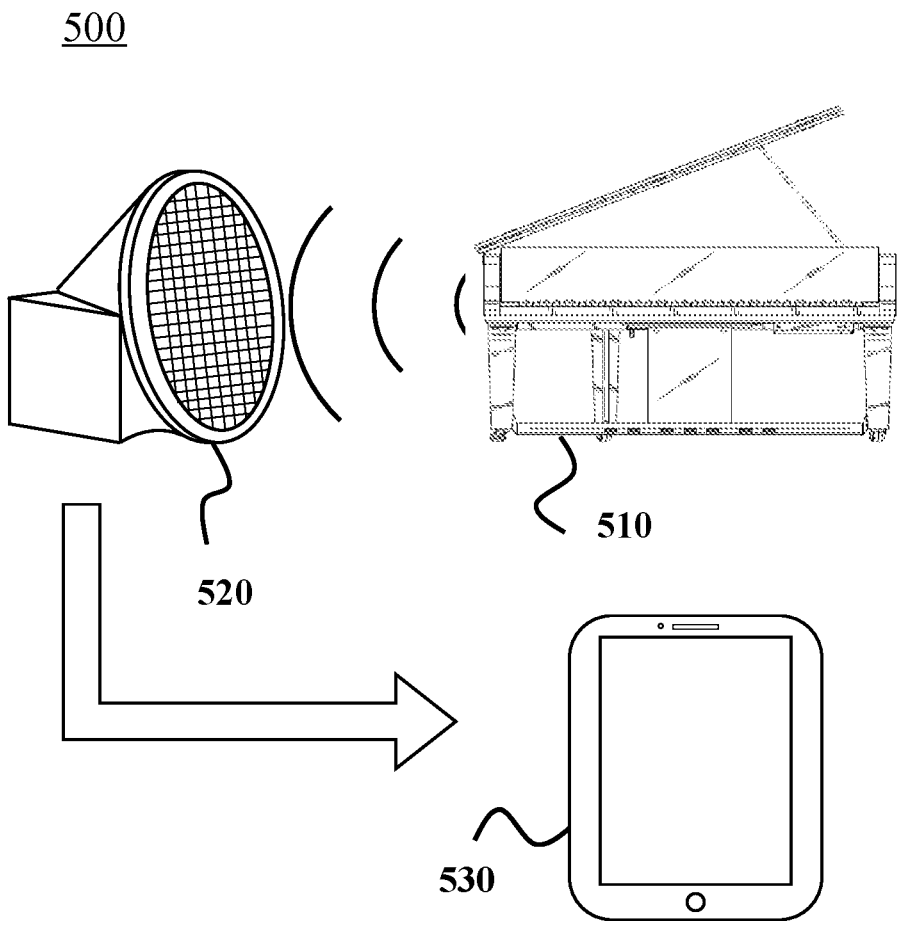
FIG. 5 is a schematic diagram illustrating an exemplary piano system according to some embodiments of the present disclosure.

FIG. 5 is a schematic diagram illustrating an exemplary piano system according to some embodiments of the present disclosure. According to the present embodiment, a user interface may be implemented on a computer device separate from a traditional piano. The traditional piano can control the information displayed on the user interface without upgrading the traditional piano. As shown in FIG. 5, traditional piano 510 may generate sound during playing. Signal acquisition module 420 may be implemented on a sound detector 520. Sound detector 520 may detect the sound generated by traditional piano 510. Signal processing module 430 may also be implemented on sound detector 520 to generate a processed detection signal. Computer module 440 may be implemented on a removable computer device 530. A wired or wireless communication may be established between sound detector 520 and removable computer device 530. Exemplary removable computer device may include PC (personal computer), mobile phone, tablet PC, laptop, or the like, or a combination thereof. The information displayed on the user interface implemented on removable computer device 530 may be controlled by traditional piano 510. When pressing a key of traditional piano 510, a corresponding sound may be generated by striking the corresponding string. The characteristics of the sound may be different because of the differences of the characteristics of the string to be stroke. As a result, the sound generated by pressing different keys may contain the identity information of the keys, which is used as a control signal. For example, the first key of traditional piano 510 may be defined as confirm button. When pressing the first key, a corresponding sound may be generated and detected by sound detector 520. After processing, the detected sound signal may be transmitted to removable computer device 530 to control the information displayed on the user interface. In some embodiments, a set of chord may be defined as one type of control signal. For example, an operation of pressing the first and the last key of traditional piano 510 are configured to control removable computer device 530 to zoom in or zoom out images displayed on the user interface. In some embodiments, an operation of pressing a key and stepping on a pedal is configured to extend the duration of the sound. A controlling method may be implemented according to the extended sound. For example, an operation of pressing the second key and stepping on the first pedal of traditional piano 510 may control removable computer device 530 to speed up a movie displayed on traditional piano 510.

It should be noted that the exemplary embodiment 500 described above is provided for the purposes of illustration, and not intended to limit the scope of the present disclosure. Apparently for persons having ordinary skills in the art, numerous variations and modifications may be conducted under the teaching of the present disclosure. However, those variations and modifications may not depart the protecting scope of the present disclosure. For example, sound detector 520 may be integrated in traditional piano 510. Removable computer device 530 may be a mobile phone and may detect sound by its microphone.

Figure 6:
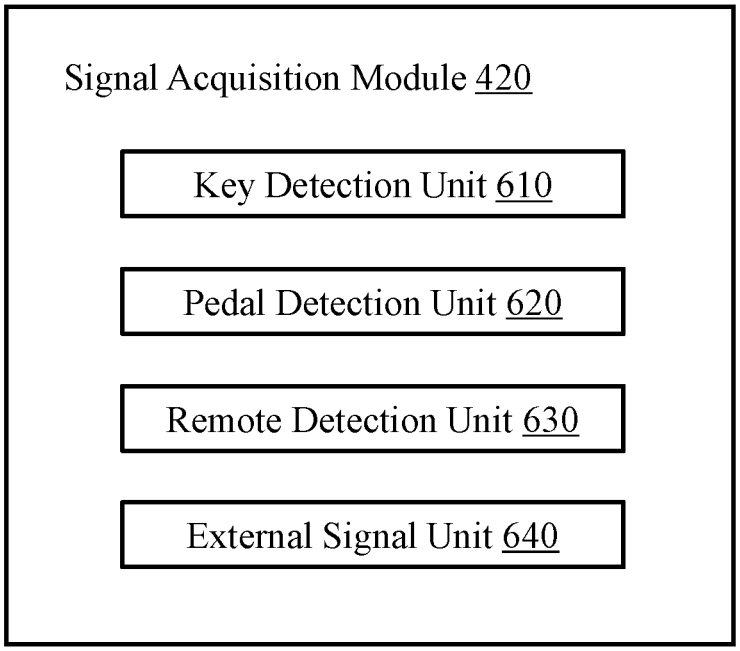
FIG. 6 is a block diagram illustrating an exemplary signal acquisition module according to some embodiments of the present disclosure.

FIG. 6 is a block diagram illustrating an exemplary signal acquisition module according to some embodiments of the present disclosure. Signal acquisition module 420 may be configured to acquire various signals that may be used to control computer module 440. The signal acquisition module may include a key detection unit 610, a pedal detection unit 620, a remote detection unit 630, and an external signal unit 640, and any other detection unit that may implement the function. For different detection signals, the different detection units may be applied respectively.

Key detection unit 610 may be configured to detect one or more events generated by keyboard 110. The events generated by keyboard 110 may be a mechanical motion event of a key, or the corresponding hammer, or any other corresponding mechanical structure configured to conduct the mechanical motion event, or the like, or a combination thereof. For example, the key pressing event may cause a hammer to strike a piece of string. The key, the hammer, the piece of string, or the like may be classified as key related components. The changes of the characteristics of these key related components may contain control information delivered by the user by pressing the keys. Key detection unit 610 may be configured to detect the changes of the characteristics of these key related components. As a result, the detection method may be determined according to the type of key related components to be detected. The detection method may include determining which type of key related components is to be detected, which type of sensor is used for the detection, where to configure the sensor for detection, etc.

In some embodiments, a motion detection sensor may be configured to detect the key motion as a control signal. Exemplary motion detection sensor may include pressure sensor chip, Hall element, electro-optical sensor, or the like, or a combination thereof. The configuration position may be determined according to the type of sensor. For example, the motion detection sensor is an electro-optical sensor. The electro-optical sensor may be configured beneath key board 110 to detect the key motion. The motion detection sensor may be configured to detect the motion of a single key of keyboard 110. In some other embodiments, the motion detection sensor is configured to detect the motion of a combination of multiple keys of the plurality of the keys. In some embodiments, the hammer motion may be detected as a control signal. The type and/or the configuration position of the motion detection sensor may be determined according to the structure of the hammer. For example, when upgrading a traditional piano, the space around the hammer area may be limited, small size motion detection sensor may be required to be able to fit in the limited space.

Pedal detection unit 620 may be configured to detect one or more events generated by pedal 120. When the pedal is trod, the mechanical motion may be delivered through a plurality of mechanical structures. These types of structures may be classified as pedal related components. The changes of the characteristics of these pedals related components may contain control information delivered by the user by stepping on the pedals. Pedal detection unit 620 may be configured to detect the changes of the characteristics of these key related components. The detection method of the pedal related components may be determined similarly to the determination of the key related components.

Remote detection unit 630 may be configured to detect one or more events generated by the piano system remotely. Exemplary remote detection method may include sound detection, visual detection, or the like, or a combination thereof. In some embodiments, when a piano according to the present disclosure is operated, the operation may be detected remotely and analyzed to extract control information associated with the operation. Remote detection unit 630 may include a remote sensor. The type of the remote sensor may be determined according to the remote detection method. For example, a microphone is used to detect sound and a camera is used to detect visual motion. In some embodiments, a camera may be used as the remote sensor. The operation of the piano by the user may be monitored during the operation. The camera may recognize which key is pressed and/or which pedal is stepped on. After the recognition, a signal may be generated by the camera according to the detected motion of the key and/or the pedal. The signal may be used as a control signal for further controlling.

External signal unit 640 may be configured to acquire the control signal transmitted from I/O device 3100. External signal unit 640 may receive control signals that may be used to control computer module 440 directly without further process. In some embodiments, the external signal unit may receive a signal generated by an HID device. The signal generated by the HID device may be further transmitted to computer module 440 directly.

Figure 7:
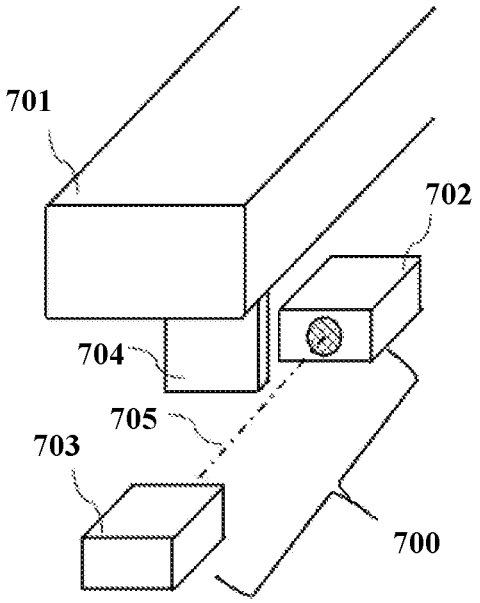
FIG. 7 is a device diagram illustrating an exemplary key detection unit according to some embodiments of the present disclosure.

FIG. 7 is a device diagram illustrating an exemplary key detection unit according to some embodiments of the present disclosure. Mechanisms for detecting motions of a key of a piano using a sensor are illustrated. The sensor may be integrated in the piano system to detect piano related information. As shown in FIG. 7, a sensor 700 may include a light-emitting element 702 and a light-detecting element 703. In some embodiments, sensor 700 may be an electro-optical sensor. An exemplary light-emitting element 702 may include visible LED, laser LED, infrared LED, laser diode (LD), photocell, etc. An exemplary light-detecting element 703 may include phototube, active-pixel sensor (APS), bolometer, charge-coupled device (CCD), gaseous ionization detector, photoresistor, phototransistor, etc. Light-emitting element 702 may generate light of various wavelengths. For example, light-emitting element 702 may generate visible light, infrared light, ultraviolet (UV) light, etc. In some embodiments, the wavelength of a beam of light emitted by light-emitting element 702 may be controlled by one or more motors using a Pulse Width Modulation (PWM) mechanism. Light-detecting element 703 may be configured to receive the light and to convert it into an electronic signal (e.g., a current signal, a voltage signal, etc.).

In some embodiments, Light-emitting element 702 and light-detecting element 703 may be positioned under key 701. In some embodiments, a non-transparent extrusion, e.g., a plate 704, may be mounted to a surface of key 701. Non-transparent plate 704 may partially or completely prevent light-detecting element 703 from receiving the light emitted by light-emitting element 702. Non-transparent plate 704 may be mounted to a lower surface of key 701 (e.g., the bottom of key 701). Light-emitting element 702 may constantly emit light towards light-detecting element 703. Light-emitting element 702 may also discontinuously emit light towards light-detecting element 703. For example, there may be one or more time intervals between light emissions. The one or more time intervals may be based on velocity of the user depressing the keys.

In some embodiments, a light beam 705 may be emitted by light-emitting element 702. When key 701 is not pressed down, the key stays at a "top" position. When a user presses key 701, the key may move downwards from the "top" position. When key 701 does not go further, it reaches an "end" position. Non-transparent plate 704 may move along with key 701 and may block one or more portions of light beam 705. The amount of the light detected by light-detecting element 703 may vary due to the movement of non-transparent plate 704. For example, when key 701 moves toward the "end" position, the amount of light detected by light-detecting element 703 may decrease. As another example, when key 701 moves toward the "top" position, the amount of light detected by light-detecting element 703 may increase. Light-detecting element 703 can determine information about the amount of the received light over time and can convert such information into one or more electronic signals (e.g., one or more key signals).

Figure 8:
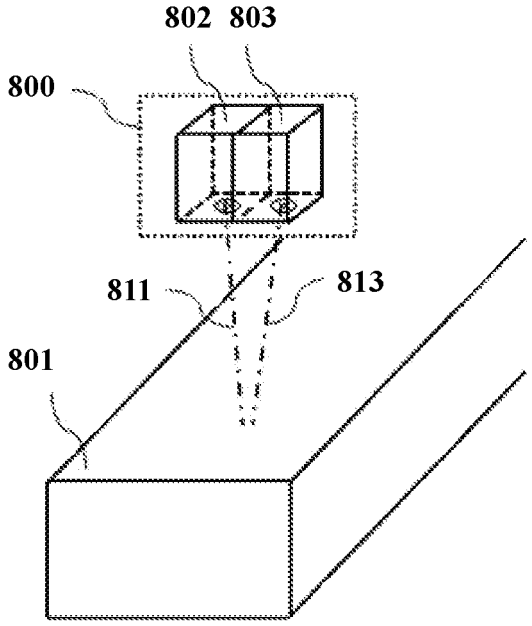
FIG. 8 is a device diagram illustrating an exemplary key detection unit according to some embodiments of the present disclosure.

FIG. 8 is a device diagram illustrating an exemplary key detection unit 800 according to some embodiments of the present disclosure. The components in FIG. 8 may be the same as in FIG. 7 except for the configuration. In some embodiments, a non-transparent plate may be omitted from the piano system. For example, light-emitting element 802 and light-detecting element 803 may be placed above or beneath key 801, and light beam 811 emitted by light-emitting element 802 may not be able to travel linearly towards light-detecting element 803. A light beam 811 emitted by light-emitting element 802 may be projected towards key 801. Light beam 811 may be reflected by key 801 once it reaches a surface of key 801 (e.g., the upper surface, the bottom surface, etc.). Reflected light 813 may then travel towards light-detecting element 803 and may be received by light-detecting element 803. When a user presses key 801, the key may move downwards from the "top" position to the "end" position. The distance that the light travels from light-emitting element 802 to light-detecting element 803 may vary due to various motions of the key. Light-detecting element 803 may determine the time between light emission and light reception to record the change in distance that the light travels. The change in distance may be converted into one or more electric signals by light-detecting element 803. Thus, the motions of the key may be recorded by sensor.

The light-emitting elements and the light-detecting elements described above are not exhaustive and are not limiting. Numerous other changes, substitutions, variations, alterations, and modifications may be ascertained to one skilled in the art and it is intended that the present disclosure encompass all such changes, substitutions, variations, alterations, and modifications as falling within the scope of the present disclosure.

Figure 9:
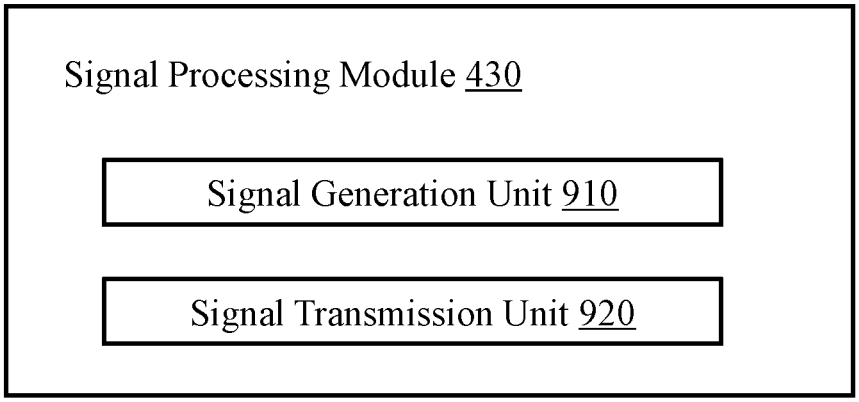
FIG. 9 is a block diagram illustrating an exemplary signal processing module according to some embodiments of the present disclosure.

FIG. 9 is a block diagram illustrating an exemplary signal processing module according to some embodiments of the present disclosure. Signal processing module 430 may be configured to process the detection signal to make it compatible for computer module 440 to read. Signal processing module 430 may be implemented by the signal processing circuit 360 disclosed above. A signal generation unit 910 and a signal transmission unit 920 may be included in signal processing module 430.

Signal generation unit 910 may be configured to generate various types of signal based on the detection signal transmitted from signal acquisition module 420. In some embodiments, the type of signal generated by signal generation unit 910 may depend on the purpose to use the detection signal. For example, the detection signal may be used to record the operation of the user. A MIDI file may include a plurality of MIDI events. A MIDI event may include information related to key pressing and/or pedal stepping for a time interval. The detection signal transmitted from signal acquisition module 420 may contain information related to the key pressing and/or pedal stepping. Therefore, the detection signal may be processed to extract such information. For a certain time interval, the extracted information may be used to construct a MIDI event. In some embodiments, the detection signal may be used to control computer module 440. The detection signal may be processed to be a control signal for further controlling.

In some embodiments, the type of the control signal may depend on the transmission method of the signal. For example, signal processing module 430 may be connected with computer module 440 by a wired connection and the control signal may be an HID signal accordingly. Signal processing module 430 may be connected with computer module 440 wirelessly and the control signal may be a wireless signal.

Signal transmission unit 920 may be configured to transmit the signal generated by signal generation unit 910. The transmission may be wired or wireless. Exemplary wireless transmission may include WIFI, Bluetooth, ZigBee, or the like, or a combination thereof. Exemplary wired transmission may through a serial port, a USB port, a PS/2 port, or the like, or a combination thereof.

Figure 10:
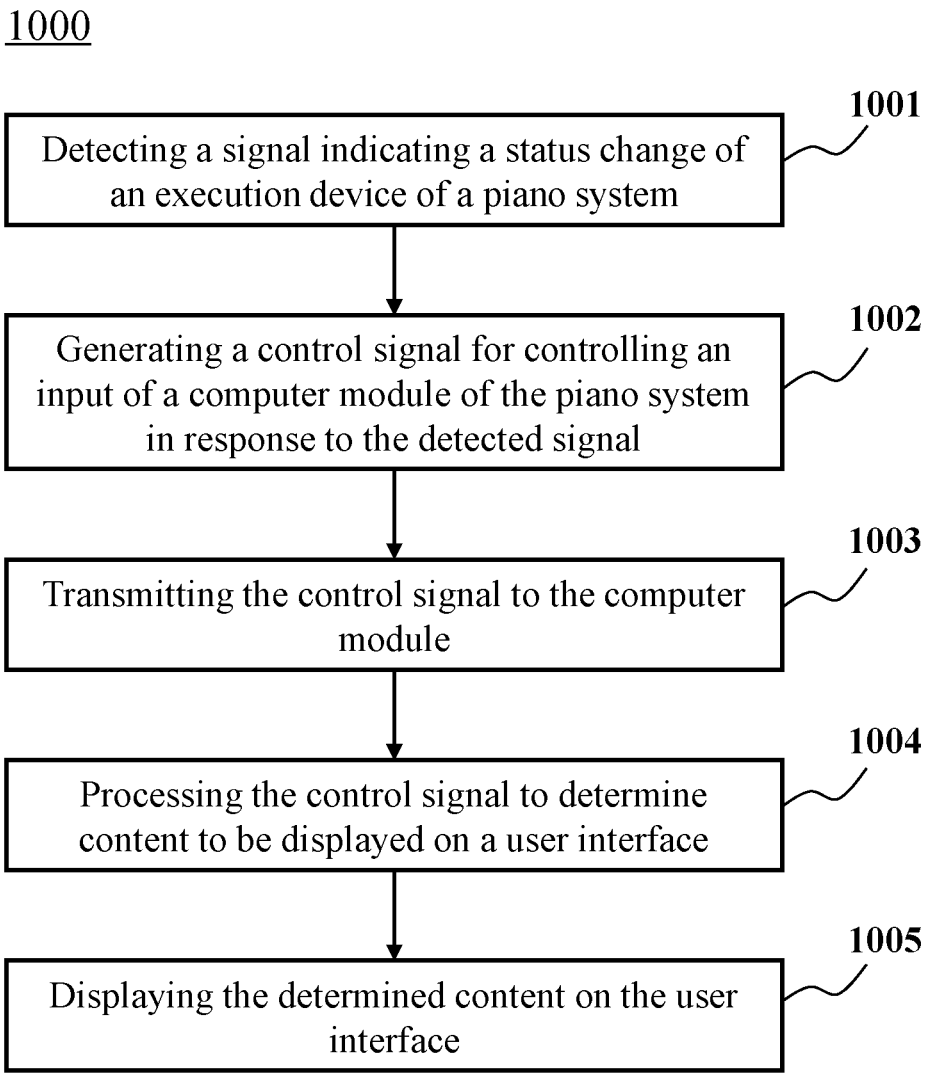
FIG. 10 is a flowchart illustrating an exemplary process for controlling a user interface according to some embodiments of the present disclosure.

FIG. 10 is a flowchart illustrating an exemplary process for controlling a user interface according to some embodiments of the present disclosure. The process and/or method may be executed by piano system 100. For example, the process and/or method may be implemented as a set of instructions stored in storage 340. Processor 320 may execute the set of instructions and may accordingly be directed to perform the process and/or the method.

In step 1001, signal acquisition module 420 may detect a signal indicating a status change of an execution device of piano system 100. In some embodiments, the execution device of a piano may refer to any component of the piano that the status of which may be changed during operation. Exemplary execution devices may include key, pedal, hammer, string, or the like, or a combination thereof. For a key of the piano, during operation, the position of which may be changed because of user's pressing. Like the key, the position of pedal may be changed because of user's stepping on. For a hammer, during operation, the position of which may be changed due to a corresponding key pressing through some mechanical structure. For a piece of string, during operation, the vibration status may be changed due to a hammer striking, and further due to a corresponding key pressing.

The status change of the execution devices may be caused by a user performance or an auto-play process. In some embodiments, the auto-play process may be implemented by auto-play module 450. For example, during an auto-play operation, the auto-play actuator may be controlled to activate one or more keys and/or pedals. In some embodiments, the user performance may contain control information by pressing different keys or stepping on different pedals.

The status change of the execution devices may generate a signal that is further detected by one or more sensors 370 included in signal acquisition module 420. For example, a motion detector may detect the motion of key, or pedal, or hammer, or the like. A vibration detector may detect the vibration of the string. A sound detector may detect the sound generated by pressing down one or more keys. Sensors 370 may detect various aspects of the status change of the execution devices. For example, a plurality of motion detectors may be configured beneath each key of keyboard 110. The motion detectors may be able to detect which key is pressed, when the key is pressed, how fast the key is pressed, how many times the key is pressed during a time interval, how many keys are pressed simultaneously, how long a key is kept pressed, or the like, or a combination thereof. For another example, a sound detector may be configured to detect the sound generated by pressing the key. The sound detector may be able to analyze which key is pressed according to a relationship between the frequency and the key. The sound detector may also be able to analyze a chord to distinguish different frequencies generated by pressing different keys simultaneously.

Various aspects of the status change of the execution devices may lead to various ways of signal input, which is further used for controlling. For example, in addition to pressing a single key, various key pressing methods may be used as a control signal. Exemplary key pressing method may include pressing multiple keys simultaneously, pressing a key in different velocity or acceleration, pressing a key multiple times for a certain time period, pressing a key and holding it for a time period, etc. These types of key pressing method may correspond to different control method that may be used to control a user interface of computer module 440.

It should be noted that the key pressing method described above is provided for the purposes of illustration, and not intended to limit the scope of the present disclosure. Apparently for persons having ordinary skills in the art, numerous variations and modifications may be conducted under the teaching of the present disclosure. However, those variations and modifications may not depart the protecting scope of the present disclosure.

In step 1002, a control signal for controlling an input of computer module 440 in response to the detected signal may be generated. This step may be implemented by signal processing module 430. In some embodiments, the detected signal may be a current value signal, a voltage value signal, or the like, or a combination there of. The detected signal may be non-compatible and/or un-readable to computer module 440, and therefore, cannot be used as a control signal directly. Therefore, the detected signal may need to be processed to generate a control signal for controlling an input of computer module 440. In some embodiments, the detected signal may be processed into an HID signal that can be recognized by computer module 440 directly. For example, the detected signal may be processed to simulate a signal generated by a keyboard, a mouse, a touch panel, or the like, or a combination thereof. The various status changes disclosed above may correspond to various operations by the keyboard, the mouse, the panel, or the like. For example, a key of keyboard 110 may correspond to a specific key of computer module 440. The correspondence may be printed on the keys of keyboard 110 or indicated by information shown on a display (e.g. display 130 in FIG. 1). When a user needs to type characters on a display, the user can press the corresponding keys of keyboard 110. In some embodiments, a set of the keys of keyboard 110 may be used to simulate a mouse motion. For example, the set of the keys may represent a plurality of directions, and if one of the set of the keys is pressed, a cursor on a display may move accordingly. If the pressing for a time interval, the cursor may keep moving. In some embodiments, the detected signal may be transmitted to the computer module 440 through a wireless connection.

In step 1003, the control signal may be transmitted to computer module 440. In some embodiments, the control signal transmission may be implemented by signal transmission unit 920. As disclosed above, computer module 440 of the piano may be integrated inside the piano or external to the piano. The connection method may determine the control signal transmission method. For example, if the computer module is integrated into the piano, the control signal is transmitted via a wired connection. If the computer module is implemented as an external module to the piano, the control signal is transmitted via a wireless connection. However, the transmission method determination disclosed above is for illustrative purpose. The present disclosure is not to limit the protection scope. For example, a wired transmission method may also be used if the computer module is disposed external to the piano.

In step 1004, the control signal may be processed to determine content to be displayed on a user interface. This step may be implemented by control unit 441 included in computer module 440. In some embodiments, a user interface may be displayed on the computer. The user interface may include a plurality of buttons and a cursor. One or more of the plurality of buttons may be clicked in response to a command. The user interface may also include one or more areas that display characters and/or numbers in response to a user input. The cursor may be moved in response to a command that is generated in response to a user's pressing a key for a time duration. The control signal described above is used to control the user interface. For example, an HID signal can be used directly to control the user interface, while a non-HID signal needs to be processed to a format compatible and/or readable by the computer.

In step 1005, the determined content may be displayed on the user interface. This step may be implemented by display unit 443 included in computer module 440. As disclosed above, display unit 443 may be integrated in the piano system, or implemented as an external module to the piano system. The controlling result may include one or more clickable buttons, one or more characters and/or numbers, and a movable cursor.

Figure 11:
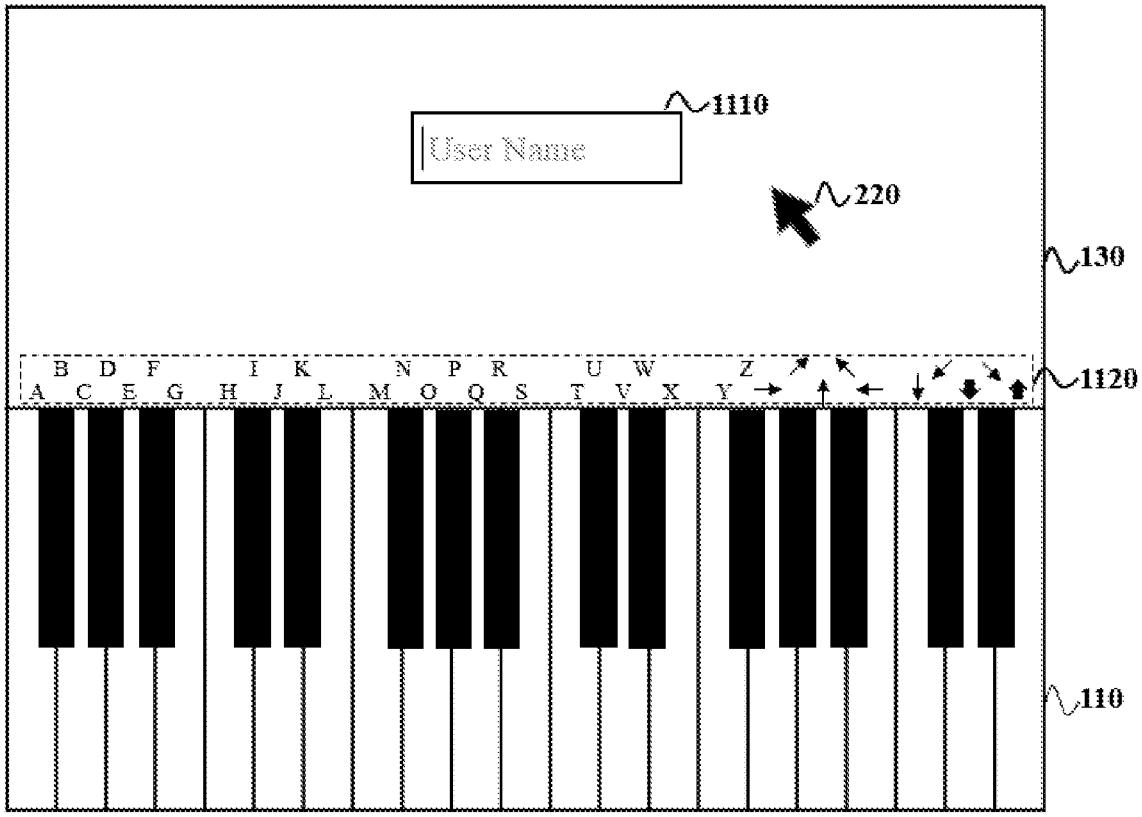
FIG. 11 is a schematic diagram illustrating an exemplary user interface according to some embodiments of the present disclosure.

FIG. 11 is a schematic diagram illustrating an exemplary user interface according to some embodiments of the present disclosure. As shown FIG. 11, user interface 130 (also referred to as a display) is configured above keyboard 110 and includes an area 1110 to display the content from a user input. Area 1110 is activated to display the content from the user input when cursor 220 clicks any part of area 1110. Before receiving the user input, area 1110 may display one or more preset words notifying the user what type of information may be typed in here. The preset words may be displayed in a different color from the outline of area 1110 and disappears automatically when the typing begins. Cursor 220 moves within user interface 130 based on the control signal disclosed above. User interface 130 may further include a key indicator area 1120 shown at the bottom of user interface 130. Characters or symbols may be shown in key indicator area 1120. As shown in FIG. 11, the characters or symbols may be arranged in two layers. Each of the characters or symbols arranged in the upper layer may correspond to a black key of keyboard 110. Each of the characters or symbols arranged in the lower layer may correspond to a white key of keyboard 110. The positions of the characters or symbols may be arranged to match their corresponding keys. The symbols may include arrows indicating directions, bold arrows, or the like, or a combination thereof. The arrows indicating directions may be used to control cursor 220. The bold arrows may be used to flip music scores displayed on the user interface.

It should be borne in mind, however, that all of these and similar terms are to be associated with the appropriate physical quantities and are merely convenient labels applied to these quantities. Unless specifically stated otherwise, as apparent from the following discussion, it is appreciated that throughout the description, discussions utilizing terms such as "sending," "receiving," "generating," "providing," "calculating," "executing," "storing," "producing," "determining," "obtaining," "calibrating," "recording," or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The terms "first," "second," "third," "fourth," etc. as used herein are meant as labels to distinguish among different elements and may not necessarily have an ordinal meaning according to their numerical designation.

In some implementations, any suitable computer readable media can be used for storing instructions for performing the processes described herein. For example, in some implementations, computer readable media can be transitory or non-transitory. For example, non-transitory computer readable media can include media such as magnetic media (such as hard disks, floppy disks, etc.), optical media (such as compact discs, digital video discs, Blu-ray discs, etc.), semiconductor media (such as flash memory, electrically programmable read only memory (EPROM), electrically erasable programmable read only memory (EEPROM), etc.), any suitable media that is not fleeting or devoid of any semblance of permanence during transmission, and/or any suitable tangible media. As another example, transitory computer readable media can include signals on networks, in connectors, conductors, optical fibers, circuits, and any suitable media that is fleeting and devoid of any semblance of permanence during transmission, and/or any suitable intangible media.

It should be noted that the piano equipped with the heat dissipation system in some specific embodiments is provided for the purposes of illustration, and not intended to limit the scope of the present disclosure. Apparently for persons having ordinary skills in the art, numerous variations and modifications may be conducted under the teaching of the present disclosure. However, those variations and modifications may not depart the protecting scope of the present disclosure.

Furthermore, the recited order of processing elements or sequences, or the use of numbers, letters, or other designations therefore, is not intended to limit the claimed processes and methods to any order except as may be specified in the claims. Although the above disclosure discusses through various examples what is currently considered to be a variety of useful embodiments of the disclosure, it is to be understood that such detail is solely for that purpose, and that the present disclosure are not limited to the disclosed embodiments, but, on the contrary, are intended to cover modifications and equivalent arrangements that are within the spirit and scope of the disclosed embodiments. For example, although the implementation of various components described above may be embodied in a hardware device, it may also be implemented as a software only solution—e.g., an installation on an existing server or mobile device.

Similarly, it should be appreciated that in the foregoing description of embodiments of the present disclosure, various features are sometimes grouped together in a single embodiment, figure, or description thereof for the purpose of streamlining the disclosure aiding in the understanding of one or more of the various inventive embodiments. This method of disclosure, however, is not to be interpreted as reflecting an intention that the claimed subject matter requires more features than are expressly recited in each claim. Rather, inventive embodiments lie in less than all features of a single foregoing disclosed embodiment.

What is claimed is:

1. A piano system with key assisted user input comprising:

one or more execution devices;

one or more sensors configured to detect a signal indicating a status change of at least one of the one or more execution devices;

at least one signal processing circuit configured to generate a control signal for controlling an input of a computer device in response to the signal detected by the one or more sensors;

a processor configured to process the control signal to determine content to be displayed on a user interface;

a display configured to display the determined content on the user interface;

wherein the content of the user interface includes a plurality of buttons, each of which is clickable in response to at least a key pressing of the piano system, and an area for displaying one or more inputs in response to one or more key pressings of the piano system, respectively.

2. The piano system of claim 1, further comprising one or more storage media, wherein the one or more storage media comprises a set of instructions for processing the control signal to determine information to be displayed on the user interface.

3. The piano system of claim 1, wherein the control signal includes an auto-play control signal, and the system further comprises an auto-play actuator configured to execute an auto-play operation of the piano system in response to the auto-play control signal.

4. The piano system of claim 1, wherein the one or more execution devices include one or more keys, one or more pedals, one or more hammers, and one or more strings.

5. The piano system of claim 1, wherein the status change of at least one of the one or more execution devices includes at least one of:

a position change of at least one of the one or more keys;

a position change of at least one of the one or more hammers;

a position change of at least one of the one or more pedals;

a vibration status change of at least one of the one or more strings; and a sound frequency change of the piano system.

6. The piano system of claim 5, wherein the status change of at least one of the one or more execution devices is caused by a user operation on the piano system.

7. The piano system of claim 1, wherein the control signal includes a Human Interface Device (HID) signal.

8. The piano system of claim 1, wherein the computer device is removable from the piano system, and the control signal is transmitted from the piano system wirelessly to the computer device.

9. The piano system of claim 1, wherein the content of the user interface further includes an indicator area, wherein the indicator area includes a plurality of characters and one or more symbols, each of which indicating a correspondence between one of the one or more keys of the piano system and one of the plurality of characters and the one or more symbols.

10. A method implemented on a computer device having at least one processor, a storage medium, and a communication platform connected to a network for key assisted user input in a piano system, the method comprising:

detecting, by one or more sensors, a signal indicating a status change of at least one of one or more execution devices of the piano system;

generating, by at least one signal processing circuit, a control signal for controlling an input of a computer device in response to the signal detected by the one or more sensors;

determining, by the at least one processor, content to be displayed on a user interface by processing the control signal;

displaying the determined content on the user interface;

the content of the user interface including a plurality of buttons, each of which is clickable in response to at least a key pressing of the piano system;

and an area for displaying one or more inputs in response to one or more key pressings of the piano system, respectively.

11. The method of claim 10, wherein the processing the control signal to determine content to be displayed on the user interface is based on a set of instructions stored in the storage medium.

12. The method of claim 10, wherein the control signal includes an auto-play control signal, and the method further comprises executing, by an auto-play actuator, an auto-play operation of the piano system in response to the auto-play control signal.

13. The method of claim 10, wherein the one or more execution devices include one or more keys, one or more pedals, one or more hammers, and one or more strings.

14. The method of claim 10, wherein the status change of at least one of the one or more execution devices includes at least one of:

a position change of at least one of the one or more keys;

a position change of at least one of the one or more hammers;

a position change of at least one of the one or more pedals;

a vibration status change of at least one of the one or more strings; and a sound frequency change of the piano system.

15. The method of claim 14, wherein the status change of at least one of the one or more execution devices is caused by a user operation on the piano system.

16. The method of claim 10, wherein the control signal includes a Human Interface Device (HID) signal.

17. The method of claim 10, wherein the computer device is removable from the piano system, and the control signal is transmitted from the piano system wirelessly to the computer device.

18. The method of claim 10, wherein the content of the user interface further includes an indicator area, wherein the indicator area includes a plurality of characters and one or more symbols, each of which indicating a correspondence between one of the one or more keys of the piano system and one of the plurality of characters and the one or more symbols.

* * * * *